US006887170B2

(12) United States Patent
Stauber et al.

(10) Patent No.: US 6,887,170 B2
(45) Date of Patent: May 3, 2005

(54) HOCKEY GOALIE TRAINING AID

(76) Inventors: Robert T. Stauber, 3520 Pinto Dr., Hamel, MN (US) 55340; Michael M. Stapf, 16120 Joplin Way, Lakeville, MN (US) 55044

( * ) Notice: Subject to any disclaimer, the term of this patent is extended or adjusted under 35 U.S.C. 154(b) by 0 days.

(21) Appl. No.: 10/695,696

(22) Filed: Oct. 29, 2003

(65) Prior Publication Data

US 2004/0087391 A1 May 6, 2004

Related U.S. Application Data

(63) Continuation-in-part of application No. PCT/US02/06363, filed on Feb. 28, 2002, which is a continuation-in-part of application No. 09/797,298, filed on Mar. 1, 2001, now abandoned.

(51) Int. Cl.[7] ..... A63B 69/00

(52) U.S. Cl. ..... 473/422; 473/450; 473/446

(58) Field of Search ..... 473/422, 446, 473/207, 212, 215, 220, 227, 275–277; 2/44, 102, 462–465, 455; 482/105, 106

(56) References Cited

U.S. PATENT DOCUMENTS 4,030,732 A * 6/1977 Vincent ..... 473/464
4,317,237 A * 3/1982 Porte ..... 2/464
4,383,685 A * 5/1983 Bishop ..... 473/450
4,422,643 A * 12/1983 Cushing ..... 473/215
4,501,023 A * 2/1985 Bilberry ..... 2/462
4,579,341 A * 4/1986 Furr ..... 473/450
4,654,893 A * 4/1987 Meyers et al. ..... 2/462
4,676,502 A 6/1987 Mahr
5,569,095 A * 10/1996 McCollum ..... 473/215
5,658,203 A 8/1997 Shub
5,890,968 A * 4/1999 Mingo ..... 473/207
6,012,993 A * 1/2000 Guerriero ..... 473/424
6,102,809 A * 8/2000 Nichols ..... 473/227
6,375,581 B1 * 4/2002 Urban et al. ..... 473/215
6,554,718 B2 * 4/2003 Back ..... 473/276
2003/0176227 A1 * 9/2003 Czaja et al. ..... 473/227
2003/0220168 A1 * 11/2003 Perry ..... 475/276

* cited by examiner

*Primary Examiner*—Mitra Aryanpour
(74) *Attorney, Agent, or Firm*—Nikolai & Mersereau, P.A.

(57) ABSTRACT

A hockey goalie-training device for teaching a goalie to keep his arms from moving behind or away from his body is provided. A garment has an arm-restricting bar removeably attached to the garment. The device teaches the goalie to keep his hands and arms positioned such that shots cannot be completed by passing a puck between his body and his arms to score a goal. The device also trains the goalie to keep his hands positioned properly on certain movements and saves such that shots cannot pass easily by the goalie, due to proper hand position. The bar is attached to a bar holding block on the garment placed in a desired location on the goalies chest. Belts or straps over the goalies shoulders or around the goalies' waist can aid in holding the bar in place. The garment can be a jersey or a padded protective suit.

5 Claims, 3 Drawing Sheets

HOCKEY GOALIE TRAINING AID

This application is a continuation-in-part of PCT/US02/06363 filed Feb. 28, 2002, which is a continuation-in-part of U.S. application Ser. No. 09/797,298 filed Mar. 1, 2001 now abandoned.

BACKGROUND OF THE INVENTION

1. Field of the Invention

This invention relates to a garment having a bar attached for training hockey goalies and more particularly for training hockey goalies to keep their arms and hands in the proper position with respect to their bodies to prevent hockey pucks from passing between their bodies and their arms.

2. Description of the Related Art

There are many sports training devices for golf, weight lifting and other sports in which the training aid limits or otherwise guides arm movements to improve performance in the sport. However there is no device available for training hockey goalies to keep their arms and hands properly positioned with respect to their bodies to prevent hockey pucks from passing by the goalies body, due to poor, incorrect or improper arm and hand positions. Particularly there are no garments with removable bars that can be quickly and easily attached or removed for this purpose.

SUMMARY OF THE INVENTION

A garment is worn by a hockey goalie having a bar attachment block on the front for attaching a bar in front of a hockey goalies' chest. The bar is easily attached to the garment when needed for training and easily removed when not needed. The bar has a curved chest portion in front of the goalies' chest supported by the bar attachment block. The bar also has a curved portion on either side of the goalies' torso for contacting the goalies' arms above the elbow. The bar is curved backward from the chest to allow room for the arms and then forward forming cups on either side of the goalie to limit the range of backward and lateral arm movement. The bar ensures that as the goalie moves around the goal crease area, the goalies' arms are always maintained in the proper position such that the arms and body move as a unit to eliminate openings through which the hockey puck can pass. The garment may have a belt or straps for attaching to each side of the bar attachment block to secure the bar attachment block and the bar to the torso of the goalie. The garment may also have adjustable length shoulder straps to hold the bar attachment block at the proper height on the goalies' chest The bar can be removeably attached to the bar attachment block by pins extending through apertures in the bar attachment block. A flap connected to the garment can cover the bar preventing the pins from coming out of the bar attachment block.

OBJECTS OF THE INVENTION

It is an object of the invention to position an arm-limiting bar at the chest level of a goalie to limit arm movement behind and away from the torso.

It is an object of the invention to train a goalie not to move his arms behind and away from his body.

It is an object of the invention to train a goalie to have his entire body move as one unit.

It is an object of the invention to provide a lightweight, easy to wear, easy to put on and easy to take off training device for hockey goalies.

It is an object of the invention to removeably attach the bar to the garment to make the training bar easier to put on and take off.

It is an object of the invention to provide a garment with a bar holding block for attaching a bar to.

Other objects, advantages and novel features of the present invention will become apparent from the following detailed description of the invention when considered in conjunction with the accompanying drawings.

DESCRIPTION OF THE PREFERRED EMBODIMENTS

Figure 1:
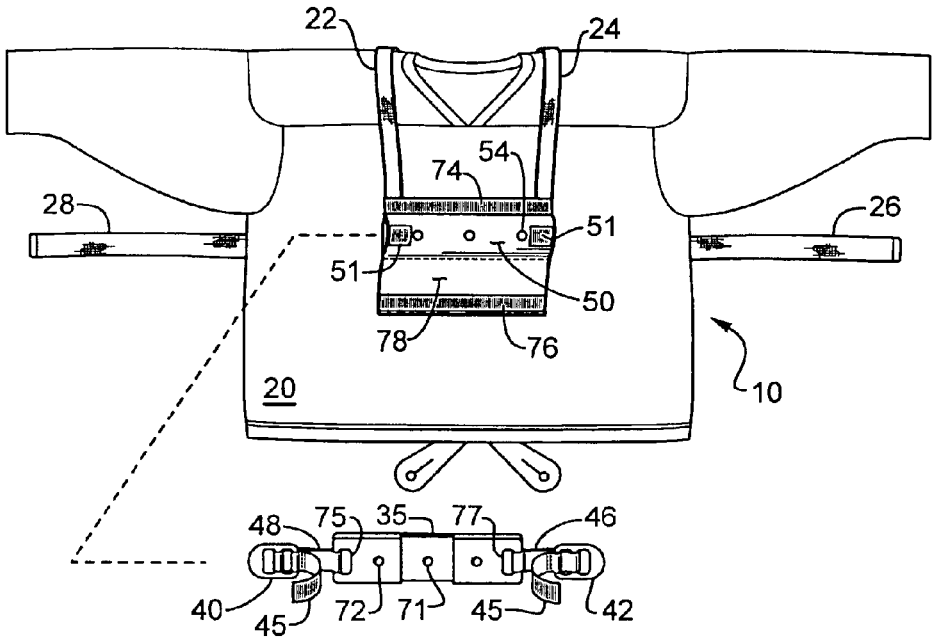
FIG. 1 is a front view of a jersey with an attachable bar holding block, without the bar attached.
Figure 2:
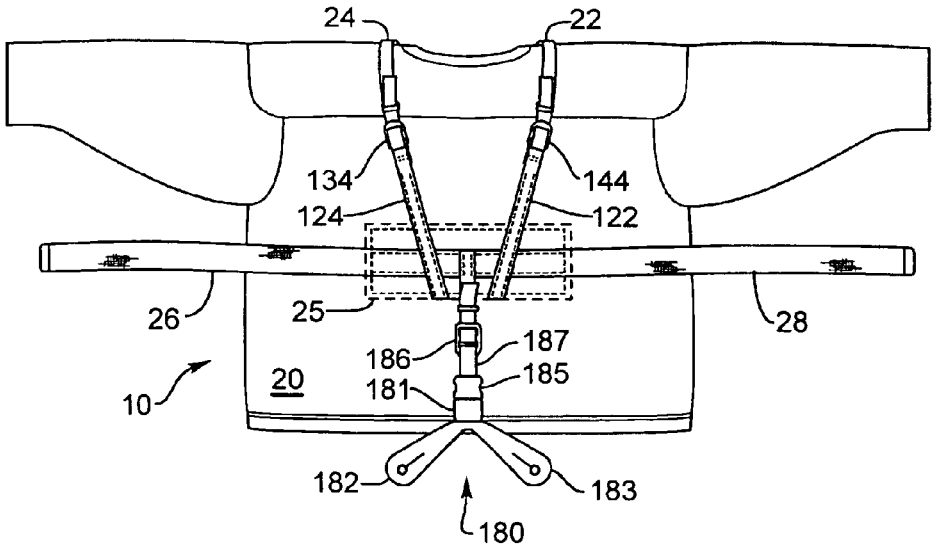
FIG. 2 is a back view of the jersey with the hockey goalie-training device.
Figure 3:
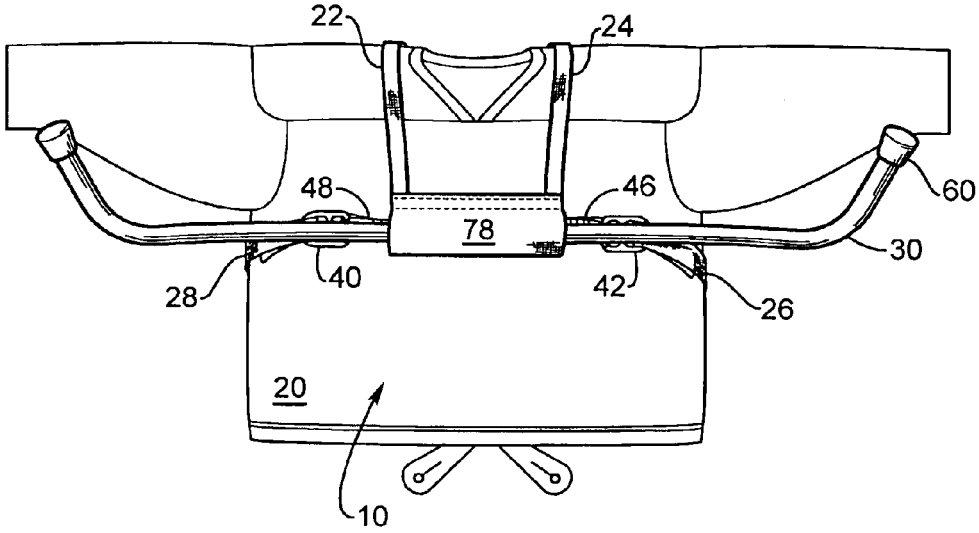
FIG. 3 is a front view of a jersey with the hockey goalie-training device with the bar attached.
Figure 4:
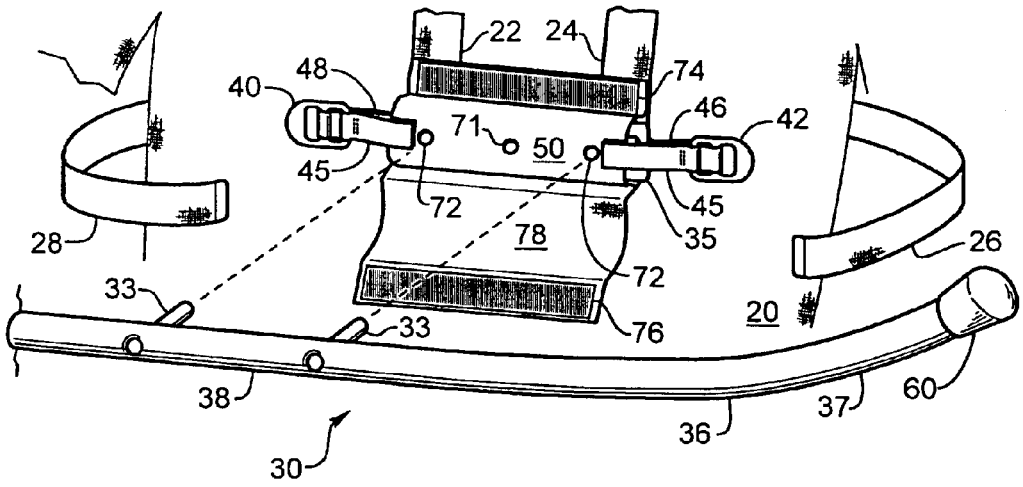
FIG. 4 is a close up view of the bar holding block of a jersey.
Figure 5:
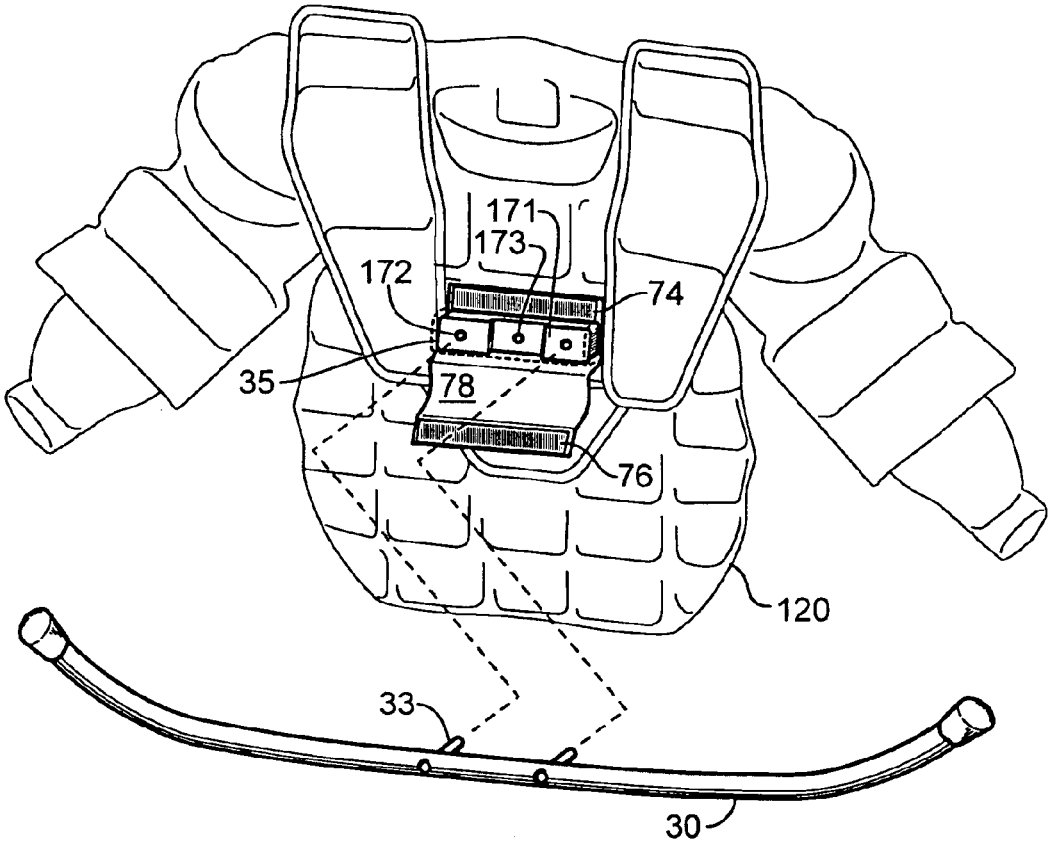
FIG. 5 is a front view of a garment having a built in bar holding block.

FIG. 1 shows a front perspective view of the hockey goalie training device 10. The hockey goalie training device 10 has a bar holding block 35 attached to a garment 20 such as a jersey as shown in FIGS. 1–3 or a padded protective goaltender suit as shown in FIG. 5. When the garment is a jersey the bar holding block 35 can be enclosed in a pouch 50 supported vertically by shoulder straps 22 and 24 and horizontally by belt straps 26 and 28 to hold the bar holding block 35 in place because the jersey does not have independent structural integrity. As shown in this embodiment shoulder straps 22 and 24 are sewn to the patch 25 which is attached to the jersey but are not sewn onto rest of the 10 jersey such that the length of the straps 22 and 24 can be adjusted. Shoulder strap 22 engages back strap 122 and shoulder strap 24 engages back strap 124 by use of strap adjusters 134 and 144.

The back straps 122 and 124 terminate at patch 25, which covers the back straps 122 and 124 for extra holding strength. Patch 25 also covers and is sewn onto belt straps 26 and 28 which are sewn onto the jersey 20, extend around to the front of the goalie and attach to strap adjusters 40 and 42 which are connected to bar holding block 35 by sewing straps 46 and 48 through slots 75 and 77 in holding block 35. Strap adjusters 40 and 42 are then used to engage and adjust straps 28 and 26 to secure the holding block in place in front of the goalie. When the bar 30 is not in use the VELCRO® strip 45 attached to straps adjusters 40 and 42 on straps 46 and 48 are secured to VELCRO® 51 on the face of pouch 50 and bar flap 78 then covers the straps 46 and 48 so that they are out of the way.

To hold bar 30 in place the bar holding block 35 has apertures 72 for receiving pins 33 on bar 30. With the bar 30 inserted into holding block 35 flap 78 on pouch 50 covers the bar and prevents the bar pins 33 from exiting the apertures 72 in holding block 35. In the embodiment shown the pouch 50 has open ends on the left and right side for inserting or removing the bar holding block 35. Pouch apertures 54 expose the apertures 72 in the bar holding block 35. With the pouch as shown in this embodiment the bar holding block 35 can be inserted for use with bar 30 and removed when the jersey is not being used in the training mode.

The pouch 50 is sewn to the jersey 20 and has an attachment means such as VELCRO® strips 74 and 76 attached at the top and bottom and the flap 78 attached to the pouch 50 such that the flap 78 can cover bar 30 and hold it in place in the bar holding block 35. Other attachment means can be zippers, buttons, snaps, or other fasteners.

The bar 30 has a chest arch portion 38 for engaging the chest of the user and a curved arm cupping portion 36 for keeping the arms of the user in front of and adjacent the body of the user. The bar 30 also has a lateral arm movement limiting portion 37 on either end for ensuring limited lateral movement of the goalies arms such that he will keep his arms adjacent to his body and thereby prevent a scoring shot from passing between the goalies arms and his body. The bar 30 teaches the goalie to move his body with his arms in a fixed position such that he pivots with his arms and body as a unit to block shots.

The bar 30 is preferably made of a round steel tubing such that it is lightweight and strong. The bar 30 also preferably has protective caps 60 on the ends to prevent injury to players if they come in contact therewith. The protective caps can be plastic, rubber, or any other material for covering the ends of the bar 30, such that players will not be impaled or otherwise injured by the ends of the bar 30. The protective caps 60 preferably have a larger cross section for coming in contact with players to lessen the impact per square inch and made of or having a softer impact absorbing material portion.

In an alternative embodiment garment 120, as shown in FIG. 5, having structural integrity can be used with the bar 30. The garment 120 can be a protective padded garment having pad blocks 171 with apertures 172, or have a built in bar holding block 35. Flap 78 and VELCRO® strips 74 and 76 are used to keep bar 30 in place when the garment 120 is used in the training mode. In this manner bar 30 is easily attached or removed.

In another alternative embodiment a threaded aperture 71 in holding block 35 may be used to bolt a laser to the goalie to shine on the coverage zone to aid in training. Similarly the laser can be attached to threaded aperture 173 in garment 120.

U.S. patent application Ser. No. 09/797,298 filed Mar. 1, 2001, for a Hockey Goalie Training Aid and PCT patent application PCT/US02/06363, filed Feb. 28, 2002, designating the U.S. and claiming priority from U.S. patent application Ser. No. 09/797,298 are both attached hereto and incorporated herein by reference.

Although the pouch 50 as shown has openings on the sides for sliding the bar holding block 35 therein the pouch 50 may alternatively have an opening in the top for inserting the bar holding block and have a means such as a zipper or snaps for securing the top of the pouch 50 to the garment 20.

The garment 20 or 120 may be a padded protective goaltender suit such as the Bauer Supreme Pro or the Vaughn VP 6000 Legacy® brands.

The shoulder straps 22 and 24 and belt straps 26 and 28 may be attached to the garment 20 in a variety of different ways. The shoulder straps 22 and 24 and back straps 122 and 124 may be connected to each other in a variety of different ways including buckles and other connectors. The shoulder straps 22 and 24 may be connected to the back straps 122 and 124 in front of the garment 20, behind the garment or on the top of the shoulder of the garment. The belt straps 26 and 28 may be attached to the garment in any manner and be attached to the bar holding block 35 or the pouch 50 in any manner so as to hold the bar 30 in the desired position on the goalies' chest.

Similarly although the bar 30 is attached to the garment 20 by pins 33 in the bar 30 being inserted into apertures 72 in a bar holding block 35 on the garment 20 any means of attaching the bar 30 to the garment 20 may be used.

Optionally a pants attachment device 180 having a female buckle attachment 181 and with pants straps 182 and 184 both having button holes 183 for attaching pants thereto, is attached to male buckle attachment 185 on strap 187 which is secured to jersey 20 by being sewn to the jersey and reinforced by patch 25. An adjuster 186 on strap 187 adjusts the height of the pants.

Obviously, many modifications and variations of the present invention are possible in light of the above teachings. It is therefore to be understood that, within the scope of the appended claims, the invention may be practiced otherwise than as specifically described.

What is claimed is:

1. A hockey goalie training device comprising:

a garment to be worn on the torso of a goalie, a bar holding block attached to the front of the garment to position the bar holding block on the chest of the goalie, a bar for attaching to the bar holding block such that the bar extends across the chest of the goalie and extends out laterally on either side of the goalie to prevent the arms of the goalie from moving away from the torso of the goalie the bar holding block has apertures therein, the bar has pins for engaging the apertures of the bar holding block, a flap attached to the garment for extending over the bar and bar holding block to keep the bar and bar holding block engaged.

2. A hockey goalie training device as in claim 1 wherein, the bar holding block is integral with the garment.

3. A hockey goalie training device as in claim 1 wherein, the bar holding block is contained within a pouch, wherein the pouch is attached to the front of the garment.

4. A hockey goalie training device as in claim 3 wherein, a shoulder strap is attached to the pouch, a back strap is attached to the back of the garment, a means for adjustably connecting the shoulder strap to the back strap to adjust the position of the pouch on the goalies' chest.

5. A hockey goalie training device as in claim 4 having, a belt strap attached to the garment, a belt strap connector attached to the bar holding block, a means of connecting the belt strap to the bar holding block.

* * * * *